US007075403B2

(12) United States Patent
Unno et al.

(10) Patent No.: US 7,075,403 B2
(45) Date of Patent: Jul. 11, 2006

(54) MOTOR PROTECTOR PARTICULARLY USEFUL WITH HERMETIC ELECTROMOTIVE COMPRESSORS

(75) Inventors: Mitsuro Unno, Mishima (JP); Yoshiaki Takasugi, Gotenba (JP); Yukinobu Serizawa, Gotenba (JP)

(73) Assignee: Sensata Technologies, Inc., Attleboro, MA (US)

( * ) Notice: Subject to any disclaimer, the term of this patent is extended or adjusted under 35 U.S.C. 154(b) by 177 days.

(21) Appl. No.: 10/679,821

(22) Filed: Oct. 6, 2003

(65) Prior Publication Data

US 2004/0100351 A1 May 27, 2004

(30) Foreign Application Priority Data

Oct. 15, 2002 (JP) ..... 2002-299758

(51) Int. Cl.
*H01H 37/54* (2006.01)
*H01H 37/14* (2006.01)

(52) U.S. Cl. ..... 337/365; 337/377; 337/343

(58) Field of Classification Search ..... 337/380, 337/333, 343, 362, 365, 377; 29/622
See application file for complete search history.

(56) References Cited

U.S. PATENT DOCUMENTS

| | | | | |
|---|---|---|---|---|
| 3,902,149 | A * | 8/1975 | Senor | 337/110 |
| 3,959,762 | A * | 5/1976 | Senor | 337/102 |
| 4,015,229 | A * | 3/1977 | Senor et al. | 337/107 |
| 4,041,432 | A * | 8/1977 | Yarworth et al. | 337/111 |
| 4,167,721 | A * | 9/1979 | Senor et al. | 337/112 |
| 4,231,010 | A | 10/1980 | Cardin | |
| 4,376,926 | A | 3/1983 | Senor | |
| 4,458,231 | A * | 7/1984 | Senor | 337/107 |
| 4,476,452 | A * | 10/1984 | D'Entremont | 337/102 |
| 4,646,195 | A * | 2/1987 | Lisauskas | 361/25 |
| 4,894,634 | A | 1/1990 | Nezuka et al. | |
| 4,914,414 | A | 4/1990 | Ubukata et al. | |
| 5,107,241 | A * | 4/1992 | Ubukata et al. | 337/368 |
| 5,847,637 | A * | 12/1998 | Takeda et al. | 337/344 |
| 5,898,555 | A | 4/1999 | Katsumata et al. | |
| 6,281,780 | B1 * | 8/2001 | Sugiyama et al. | 337/137 |
| 6,396,381 | B1 | 5/2002 | Takeda | |
| 6,448,883 | B1 | 9/2002 | Hofsass | |
| 6,515,571 | B1 * | 2/2003 | Takeda | 337/375 |
| 6,577,223 | B1 * | 6/2003 | Takeda | 337/377 |
| 2002/0044039 | A1 | 4/2002 | Takeda | |

FOREIGN PATENT DOCUMENTS

| | | |
|---|---|---|
| DE | 19909059 A1 | 9/2000 |
| DE | 10037161 A1 | 2/2001 |

(Continued)

*Primary Examiner*—Anatoly Vortman
(74) *Attorney, Agent, or Firm*—Russell E. Baumann

(57) ABSTRACT

A protector (1) has a metal header (30) that mounts a first terminal (31) and a second terminal (32) electrically isolated from one another. A metallic housing (10) is fixed to the header (30) and forms a chamber. A stationary contact (40) is electrically connected to the first terminal (31), a heater (50) is electrically connected between the second terminal (32) and the header (30), and an arm assembly (60) is arranged inside the chamber, with an end thereof being fixed to the housing. The arm assembly (60) includes an electrically conductive movable plate (70) having a movable contact (77) engageable with the stationary contact (40), a thermally responsive member (80) arranged at a position where it lies over or under the movable plate (70) and an electrically conductive weld slug (90) that fixes the movable plate (70) and the thermally responsive member (80) to the housing (10).

16 Claims, 15 Drawing Sheets

FOREIGN PATENT DOCUMENTS

DE 10151107 A1 4/2002

EP 0564150 A1 10/1993

* cited by examiner

MOTOR PROTECTOR PARTICULARLY USEFUL WITH HERMETIC ELECTROMOTIVE COMPRESSORS

FIELD OF THE INVENTION

This invention relates generally to a motor protector for use with hermetic type electromotive compressors and more particularly to an internal protector which is to be used within hermetic type electromotive compressors.

BACKGROUND OF THE INVENTION

An internal protector is typically used in electromotive compressors to detect excess current that flows to the motor or to detect elevated ambient temperatures resulting from an abnormal operation or a constrained operation. Such a protector includes a thermally responsive bimetal element that responds to the excess current or elevated ambient temperature; it opens the circuit that supplies current to the motor on the occurrence of an overload operation or a constrained operation, thereby protecting the motor from damage due to burning or the like.

A fusite pin assembly (or an air-tight sealed terminal assembly) is provided in hermetic type electromotive compressors for the purpose of providing an interface with an external power supply source. The assembly includes a common terminal, a main coil terminal and a supplementary coil terminal and the internal protector is connected in series between the common terminal and the motor winding in the electromotive compressor.

FIG. 21 shows a cross section of a hermetic motor protector made according to the prior art. As shown in FIG. 21, protector 200 includes a housing 210 made of metal and a metal header 220 that mounts various component parts. The outer peripheral portion of header 220 is fixed and electrically connected to housing 210 and serves as a terminal. Header 220 has a hole at its center and a pin 221 is mounted in the hole electrically insulated from header 220 by means of a glass seal 222. Pin 221 is electrically connected to a stationary plate 230 in housing 210. Stationary plate 230 mounts one end of a snap-acting bimetal disc 231 by means of a weld slug 232. A movable contact 233 is disposed at the other end of bimetal disc 231 and the movable contact 233 is movable into engagement and out of engagement with a stationary contact 211 mounted on the wall of housing 210.

Pin 221 of protector 200 is connected to the common terminal of the electromotive compressor and housing 210 is electrically connected to the winding side of the motor. During normal operation of the electromotive compressor, electric current that is supplied from the common terminal to pin 221 flows to the motor coil through stationary plate 230, bimetal disc 231, movable contact 233, stationary contact 211 and housing 210. If, due to some reason whatsoever, the rotor of the motor of the electromotive compressor cannot rotate and an excess current (which will hereafter be referred to as the constrained current) flows to the rotor, heat is generated in the path described above and when it reaches the preset actuation temperature of bimetal disc 231, the disc snaps from one curved configuration to an opposite configuration and the movable contact 233 moves away from stationary contact 211, thereby opening the power source circuit. As a result, the motor of the electromotive compressor is protected from possible damage. Conventional motor protectors as described above have the following limitation: although such motor protectors have been very effective in protecting conventional equipment from any possible damage, improvements in the efficiency of the equipment to be protected in recent years has resulted in a decrease in the difference between the operating current during normal or rated operation and the constrained current which occurs during abnormal operation. As a result, operation of the equipment to be protected can be interrupted by the motor protector during times of rated operation. In other words, if a short-term excess load operation occurs in rated operation, operating efficiency of the equipment would be improved without causing deleterious affects if operation is not interrupted. Protector 200, shown in FIG. 21, is actuated by the heat generated by the current that flows to bimetal disc 231 and the ambient temperature that is transmitted to the bimetal disc. As the resistance of bimetal disc 231 is comparatively high, however, the amount of heat generated can be large even if the electric current is small. Because of this, the rated current (or the overload current at a time of a permissible overload operation) that can be caused to flow during a rated operation is restricted and, even during a permissible overload operation, there are cases where bimetal disc 231 is instantaneously actuated in snap action.

During a period of permissible overload operation, on the other hand, it would be desirable to control the generation of heat by the electrically conductive path including bimetal disc 231 and to discharge the heat that has been generated from components where it is not desired so as to prevent actuation of snap acting bimetal disc 231 during a period of permissible overload operation. In the case of the protector shown in FIG. 21, however, the stationary plate 230 that mounts bimetal 231, etc. is disposed away from housing 210, with a result that it is difficult to discharge the heat generated by the internal members such as the bimetal disc, etc. In addition, the conductive path L between pin 221 and bimetal 231 contributes to the generation of heat and this, too, lowers the electric current that goes to the protector.

SUMMARY OF THE INVENTION

An object of the invention is the provision of a protector which overcomes the limitations noted above and to improve the operating efficiency of the equipment that is to be protected. Another object of the invention is the provision of a protector which is capable of minimizing the difference between the rated operating current and the constrained operating current of the equipment to be protected. Yet another object of the invention is the provision of a protector in which actuation of snap action of the bimetal disc is accurately controlled. Still another object of the invention is a protector that incorporates an improvement over conventional protectors for hermetic type electromotive compressors.

According to the invention, a protector made according to the invention comprises a metal header that secures a first and a second terminal in electrically insulated relationship with one another, a metal housing secured to the header so as to form a chamber, a stationary contact disposed within the chamber which is electrically connected to the first terminal, a heater disposed within the chamber that is electrically connected to the second terminal in such a fashion as to form a current path between the second terminal and the header and an arm assembly which is arranged in the chamber and having an end thereof secured to the housing. The arm assembly includes an electrically conductive movable plate including a movable contact adapted to engage the stationary contact, a thermally responsive, snap acting member arranged adjacent to, such as to lie over or under the movable plate, and an electrically conductive stationary weld slug member that secures the movable plate and the thermally responsive member to the housing. The thermally responsive member of the protector (preferably a bimetal snap acting disc) is not part of the main circuit path so that generation of heat by the thermally responsive member is not a factor and there is no issue of restricting the current that is caused to flow to the protector by the thermally responsive member. As a consequence of this, the electric current can be larger at the time of rated operation of the equipment to be protected than in the case of the conventional protector. By making a difference between constrained current during constrained operation and overload current during an overload operation for the motor relative to the equipment to be protected, for example, it becomes possible to improve the operating efficiency of the equipment to be protected.

Preferably, one end of the movable plate and the thermally responsive member are fixed in cantilever fashion by the stationary weld member. A window is formed at the other end of the movable plate, and the other end of the thermo-responsive member is inserted into the window so that the movable plate is moved when the thermally responsive member is actuated and snaps from one dished configuration to an oppositely shaped configuration. It is desirable for the other end of the thermally responsive member to be loosely fitted inside the window to thereby prevent undesirable movement of the movable plate from occurring caused by any creep phenomenon of the bimetal disc or the like.

Preferably, a protrusion is formed on the movable plate to function as a fulcrum for the thermally responsive member when it snaps over. Movement of the other end of the thermally responsive member is accentuated by use of the fulcrum. A stiffening flange part is formed on the side of the movable plate by bending a portion thereof. Preferably, the flange is formed from said one end of the movable plate extending to a position aligned with the protrusion and, by stiffening this portion, displacement of the position of the protrusion is minimized as much as possible. As a result, the fulcrum stays at an essentially constant location at all times and this stabilizes contact pressure between the contacts as well as the actuation temperature of the thermally responsive member.

The position of the movable contact and the force between the movable and stationary contacts can be adjusted preferably by plastic deformation of the housing where the arm assembly has been fixed thereby allowing external calibration of the protector.

Preferably, the two terminals protrude through the inside surface of the header into the chamber space enclosed by the housing. The stationary contact has a first part forming a contact surface adapted to engage the movable contact, a second part whose cross sectional area is smaller than the first part, and a third part that extends from the second part, with the third part being fixed to the first terminal. By making the thermal capacity of the first part of the stationary contact relatively larger than the second part, it becomes possible to minimize heat generation of the contact part of the current path.

Preferably, the heater includes a first connective part, a second connective part and a fuse part disposed between the first and second connective parts. The cross sectional area of the fuse part is reduced relative to the first and second connective parts. The first connective part is fixed to the second terminal and the second connective part is fixed to the header with the heater bent into a curved configuration. Because of this, it becomes possible for the heater to be arranged in a limited space and the size of the heater itself is minimized, with a result that the generation of heat transmitted to unnecessary parts can be minimized and the heat from the heater can be efficiently transmitted to the arm assembly.

Preferably, an opening is formed at one, fixed, end of the movable plate and the thermally responsive member and the stationary weld member includes a protrusion which is received through the openings and welded to the inner wall of the housing. Because one end of the arm assembly is connected to the housing whose thermal capacity is large, it becomes possible for the heat generated by the movable plate, which serves as a conductive path, to be effectively discharged into the housing. As a result, it becomes possible to minimize the difference between the constrained current during a constrained operation and the overload current during an overload operation as much as possible for equipment to be protected such as the motor.

Additional objects and features of the invention will be set forth in part in the description which follows and in part will be obvious from the description.

The objects and advantages of the invention can be realized and attained by means of the instrumentalities, combinations and methods particularly pointed out in the appended claims.

BRIEF DESCRIPTION OF THE DRAWINGS

The accompanying drawings, which are incorporated in and constitute a part of the specification, illustrate preferred embodiments of the invention and, together with the description, serve to explain the objects, advantages and principles of the invention. In the drawings.

DETAILED DESCRIPTION OF PREFERRED EMBODIMENTS

Figure 1:
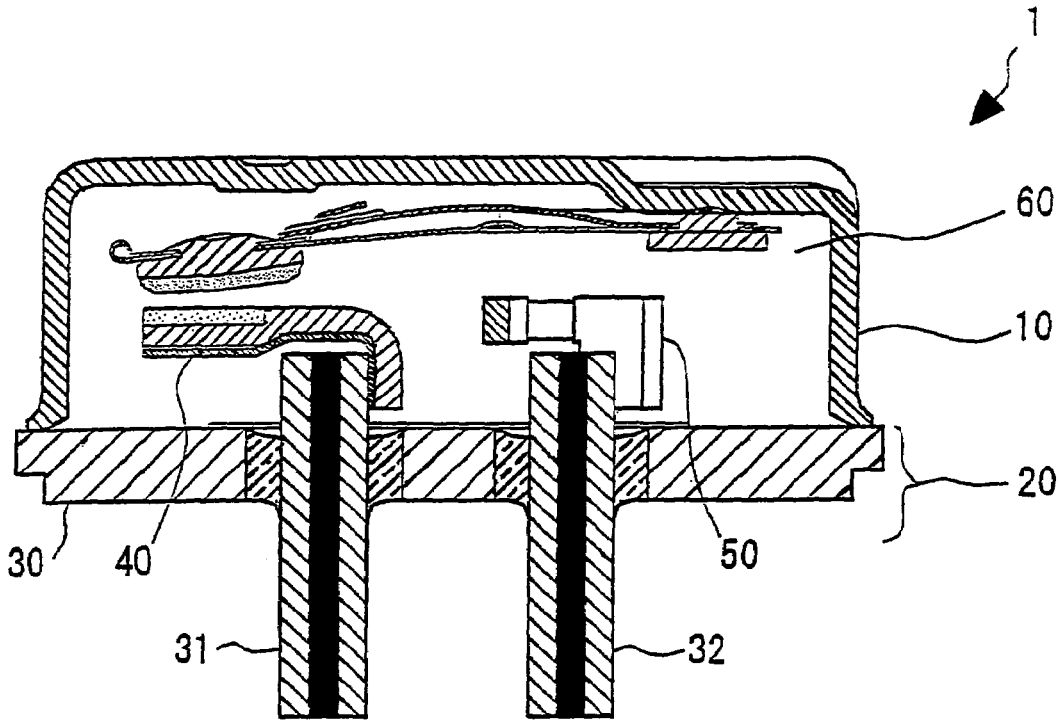
FIG. 1 is an elevational, cross sectional view of a protector made according to a preferred embodiment of the invention.
Figure 2:
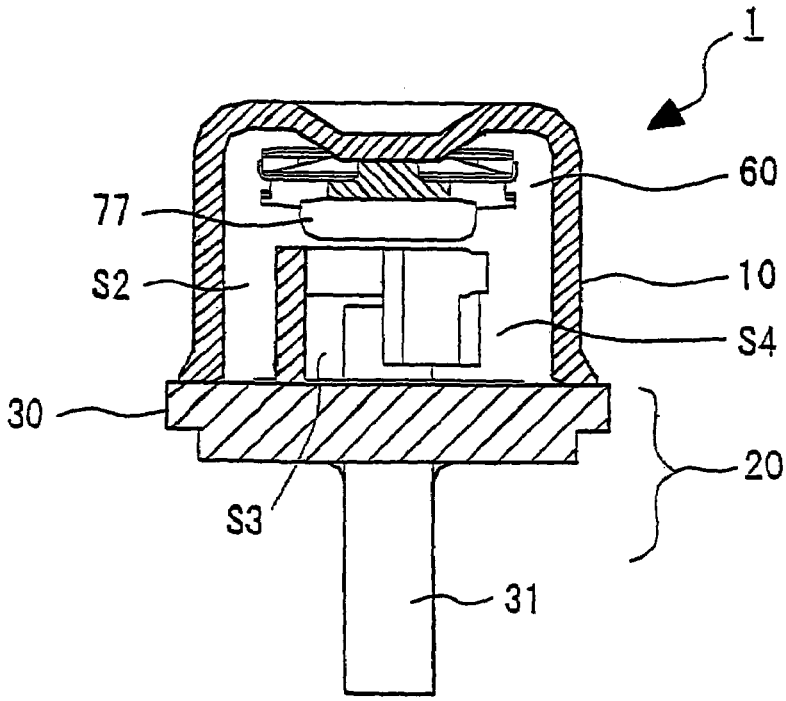
FIG. 2 is an elevational, cross sectional view taken in a direction which is perpendicular to the cross section of the protector shown in FIG. 1.
Figure 3A:
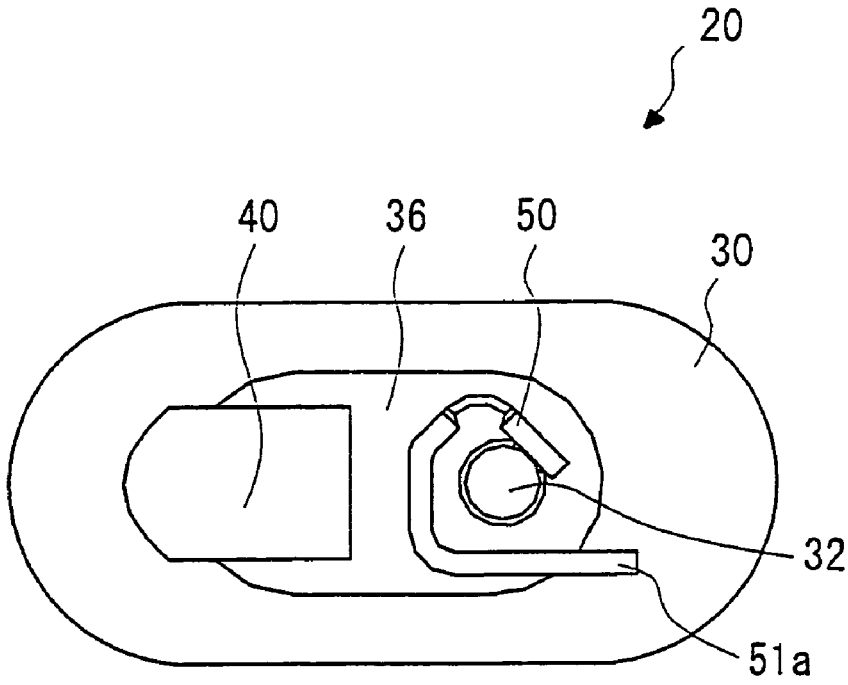
FIG. 3(*a*) is a top plan view of the header pin assembly shown in FIG. 1, FIG. 3(*b*) is a side view of the header pin assembly and FIG. 3(*c*) is a front elevational view thereof.
Figure 3B:
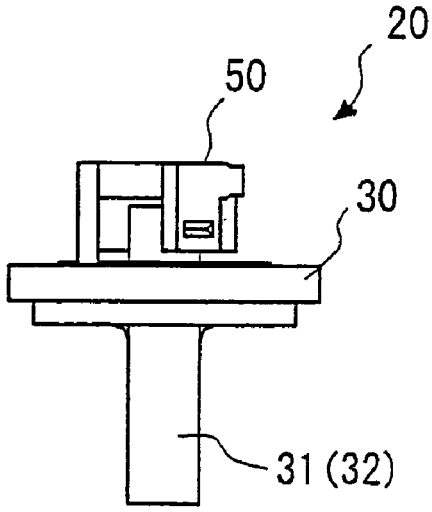
Figure 3C:
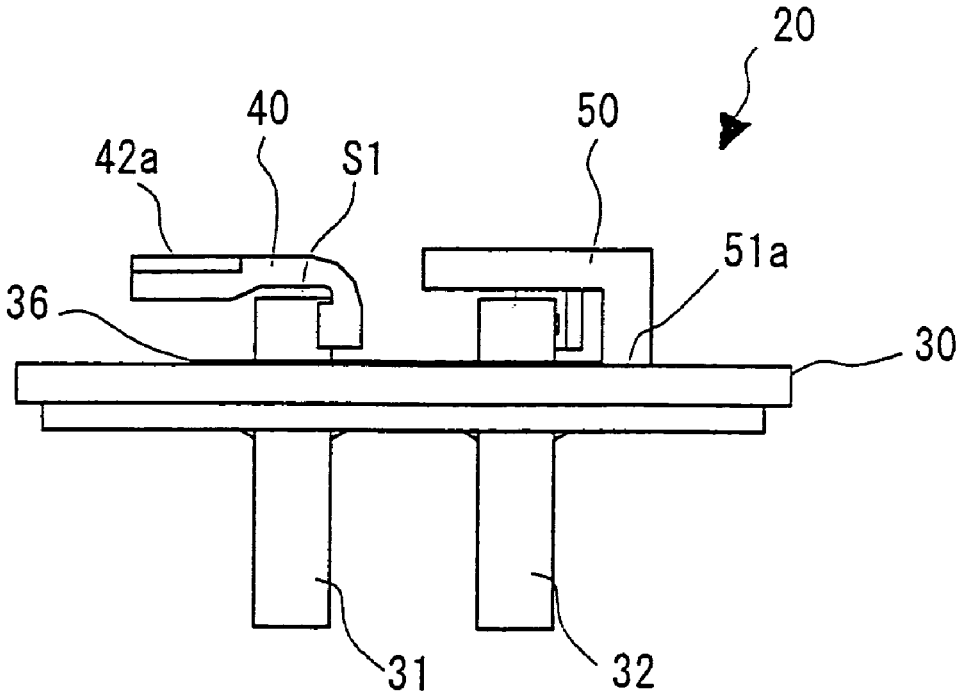
Figure 4A:
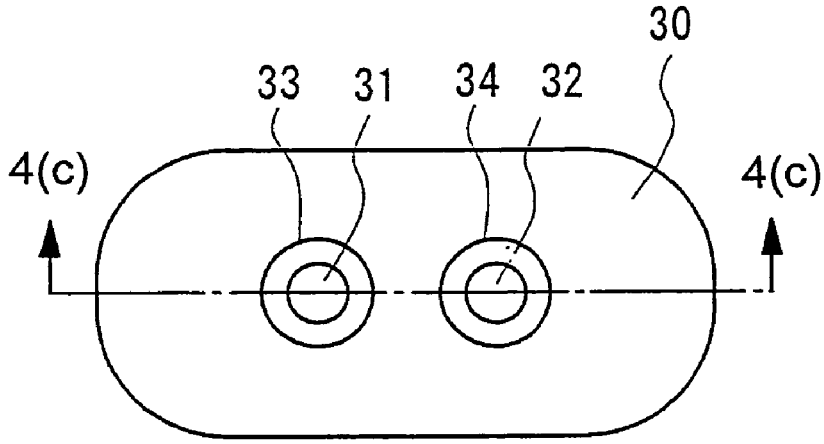
FIG. 4(*a*) is a top plan view of the header and pins, FIG. 4(*b*) is a side view thereof, FIG. 4(*c*) is a cross section taken along line 4(*c*)—4(*c*) of FIG. 4(*a*) and FIG. 4(*d*) is a bottom plan view of the header and pins.
Figure 4B:
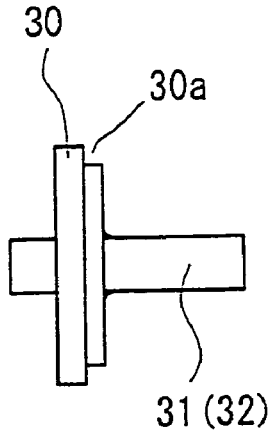
Figure 4C:
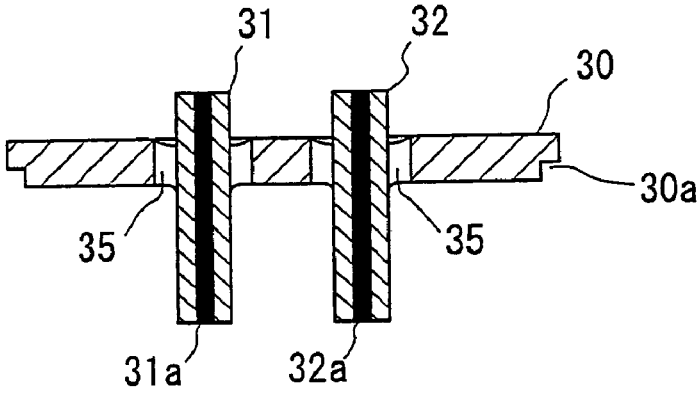
Figure 4D:
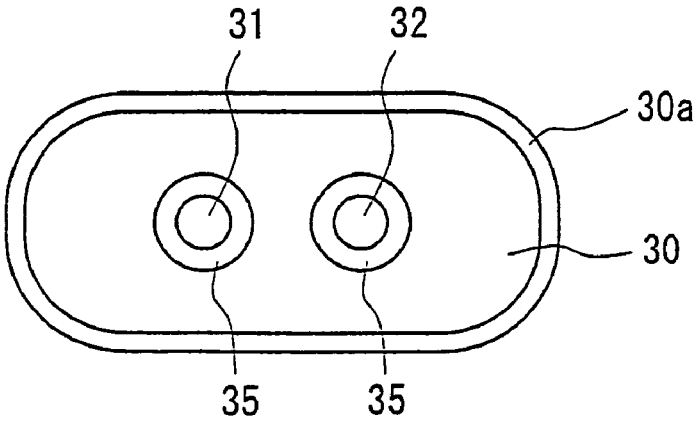
Figure 7:
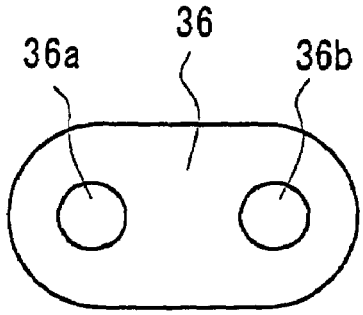
FIG. 7 is a top plan view of an insulating film on the header.

With particular reference to FIGS. 1 and 2, protector 1 has a cup-shaped metal housing 10 that accommodates a movable plate assembly 60 and forms an internal space or chamber closed by a header pin assembly 20. Header pin assembly 20 includes a header 30, a pair of electrically conductive pins 31 and 32, a stationary contact 40 and a heater 50 (see also FIG. 3). Header 30 is a metal member in the form of a thin plate, such as steel, shown in FIG. 4, with each corner being rounded. Openings 33 and 34 are formed in header 30 for the purpose of accommodating and fixing pins 31 and 32. A stepped portion 30*a* is formed on the outer periphery of header 31. Pins 31 and 32 are oblong cylindrical metal members that respectively, contain cores 31*a* and 32*a* inside. The inner cores 31*a* and 32*a* may be of a low-resistance material of copper or copper alloy, with the cores being covered by iron or iron alloy. Pins 31 and 32 have a smaller diameter than openings 33 and 34 of header 30 and are mounted in the openings, electrically insulated from the metal plate by means of glass seals 35. Pins 31 and 32 protrude to a prescribed height from the surface of header 30 and are respectively connected to stationary contact 40 and heater 50 (see FIG. 3(*c*). An insulating film 36 (FIG. 7) that has openings 36*a* and 36*b* corresponding to pins 31 and 32 is disposed on the surface of header 30 as shown in FIGS. 3(*a*), 3(*b*) and 3(*c*). Pins 31 and 32 also protrude from the opposite surface of header 30 and function as the external terminals, with pin 31 being electrically connected to the common terminal and pin 32 electrically connected to the motor coil.

Figure 5A:
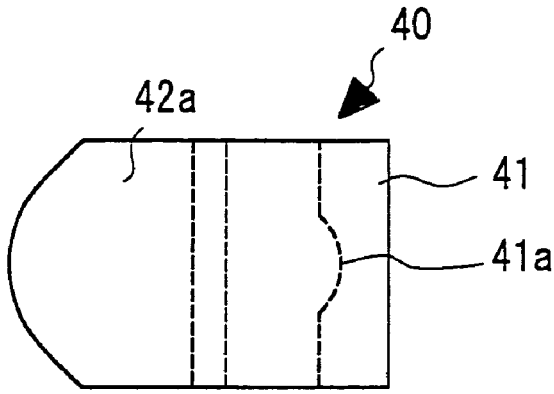
FIG. 5(*a*) is a top plan view of the stationary contact, FIG. 5(*b*) is a left side elevational view and FIG. 5(*c*) is a front elevational view of the contact.
Figure 5B:
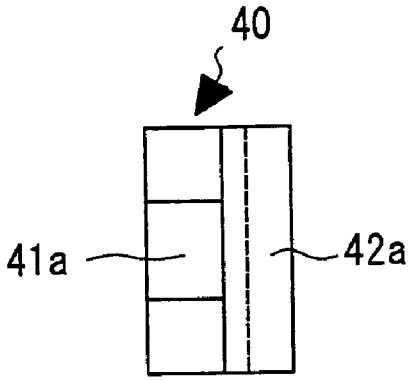
Figure 5C:
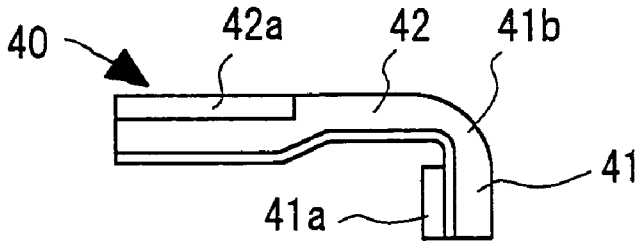
Figure 6A:
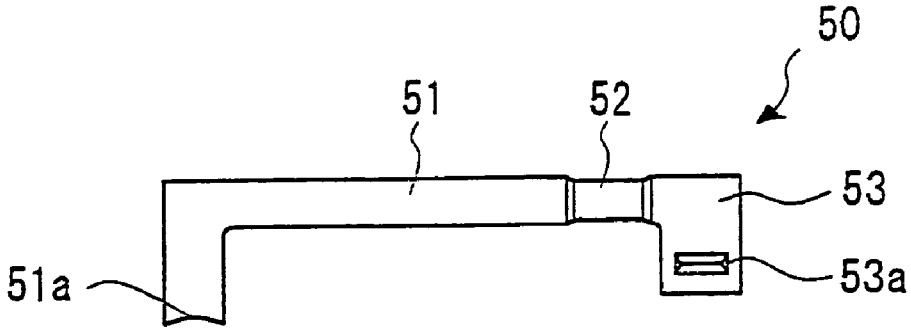
FIGS. 6(*a*) and 6(*b*) are front and bottom views of the heater prior to bending and FIGS. 6(*c*), 6(*d*) and 6(*e*) are a top plan view, side view and the front view respectively, of the heater after bending.
Figure 6B:
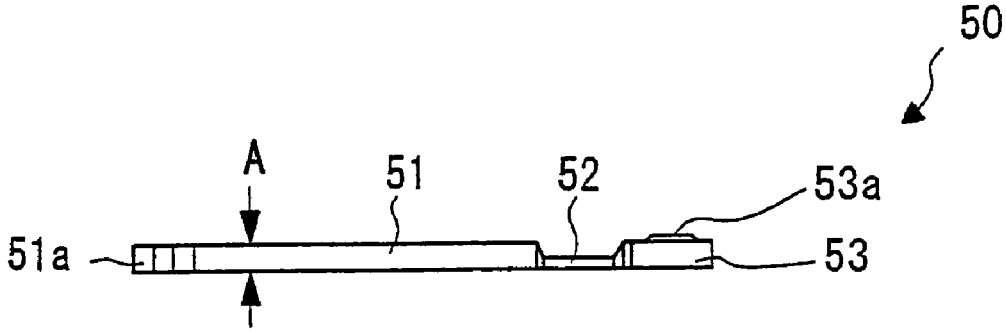
Figure 6C:
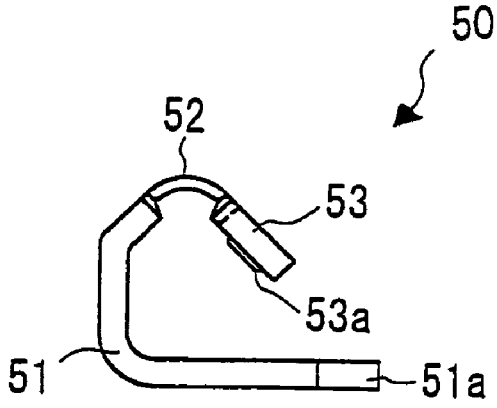
Figure 6D:
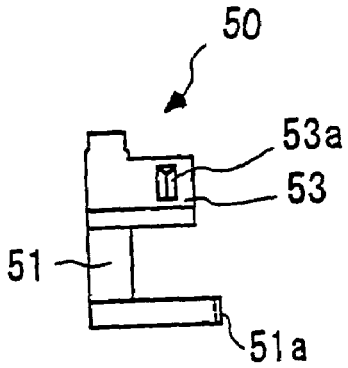
Figure 6E:
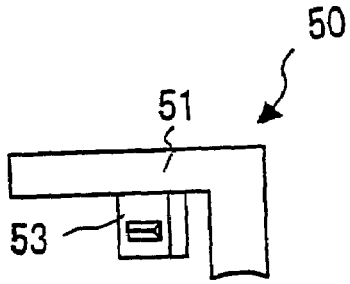

A stationary contact 40 is connected to the side of pin 31 on header 30. As seen best in FIGS. 5(*a*), 5(*b*), 5(*c*), stationary contact 40 is a multilayered metal structure with laminated layers of silver, copper, and iron, etc. Stationary contact 40 includes a base 41 made of iron and a contact part 42 which is bent, approximately perpendicularly, from base 41.

Base part 41 includes copper on its inside surface, with said copper material having a curved surface 41*a*. The curvature of the curved surface 41*a* is somewhat larger than the curvature of the outer periphery of pin 31 and, when stationary contact 40 is to be installed on pin 31, the curved surface 41*a* is welded to the side of pin 31. The contact part 42 includes a wide and flat contact surface 42*a* formed by placing a laminate of silver and copper on the iron. A constricted part 41*b* between contact part 42 and base part 41 is formed having smaller cross sectional areas relative to contact part 42 and base part 41. By making the thickness of the contact part 42 relatively large, the thermal capacity of contact part 42 is made larger.

Stationary contact 40 is configured so that the contact part 42 is held approximately horizontally on the vertically disposed pin 31 and, because of the constricted part 41*b*, a space S1 is formed between the end surface of pin 31 and the lower surface of contact part 42. (Reference should be made to FIG. 3(*c*).) The provision of space S1 minimizes dispersion of heat from stationary contact 40. Bending of contact part 42 from base part 41 of stationary contact 40 and constricting part 41*b* also makes it possible to increase the thermal capacity of contact part 42, thereby making it possible to minimize heat generation by stationary contact 40.

FIGS. 6(*a*) and 6(*b*) show heater 50 prior to being subject to a bending operation. FIGS. 6(*c*), 6(*d*) and 6(*e*) show the heater subsequent to bending. Heater 50 is formed by punching a metal plate such as an iron plate, for example, and includes a main body 51, a fuse part 52 connected to main body 51 and a connective part 53 connected to fuse part 52. Main body 51 and the connective part 53 have approximately the same thickness; however, the thickness and width of the fuse part 52 and resulting cross sectional area is less than main body 51 and connective part 53. Fuse part 52 is formed by means of stamping, for example. A protrusion 53*a* for welding to pin 32 is formed on the surface of connective part 53 as by stamping. An extension part 51*a* is formed at the end of the main body 51 extending perpendicularly to the main body.

Heater 50 is bent at a location which is approximately the center of main body 51 and at the location of fuse part 52 and is bent approximately in the shape of C. The terminal face of extension 51*a* which extends in a normal direction from main body 51 is welded to the surface of header 30 at a location of the header not covered by insulating film 36 and, at the same time, the protrusion 53*a* of connective part 53 is welded to the side of pin 32. (Reference may be made to FIGS. 3(*a*) and 3(*c*).)

When heater 50 is installed on pin 32, main body 51 of the heater is at approximately the same height as contact surface 42*a* of stationary contact 40. When heater 50 is installed, an electrically conductive path is formed from pin 32 to connective part 53, including protrusion 53*a*, fuse 52, main body 51 and extension part 51*a* to header 30. The controlling part of heater 50 is main body 51 and heat is generated by electric current that flows therethrough. The fuse part having a smaller cross sectional area than the main body 51 and the connective part 53 is melted by the heat if current flow is greater than a selected value.

Bending heater 50 enables placement of heater 50 in a restricted space on header 30 while providing spaces S2, S3 and S4 as well as space S1 (see FIG. 2). Spaces S2, S3, and S4 provide the advantage of minimizing undesirable transmission of heat to other component parts. The amount of heat generated by the heater can be adjusted, prior to bending of heater 50, by adjusting the cross sectional area of the heater (dimension A shown in FIG. 6(*b*)) in order to obtain a desired resistance value and to provide flexibility in designing the layout of the heater in the limited available space.

Figure 8A:
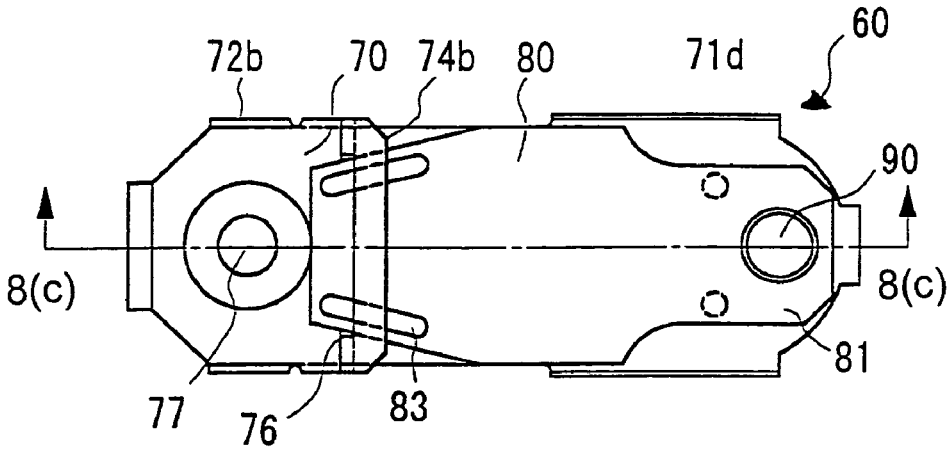
FIG. 8(*a*) is a top plan view of the arm assembly, FIG. 8(*b*) is a side view thereof and FIG. 8(*c*) is a cross section taken along line 8(*c*)—8(*c*) of FIG. 8(*a*)
Figure 8B:
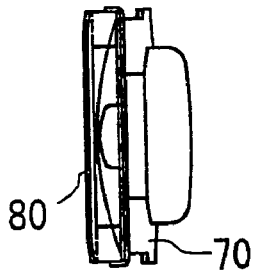
Figure 8C:
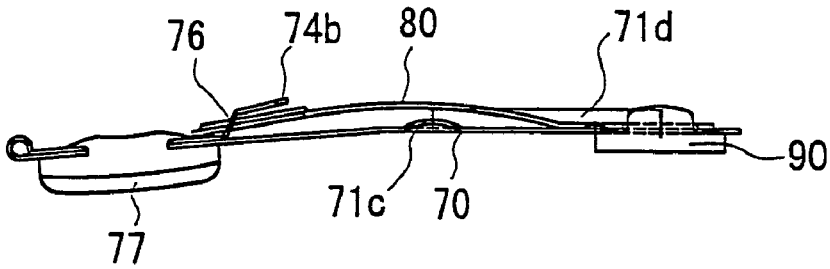
Figure 9A:
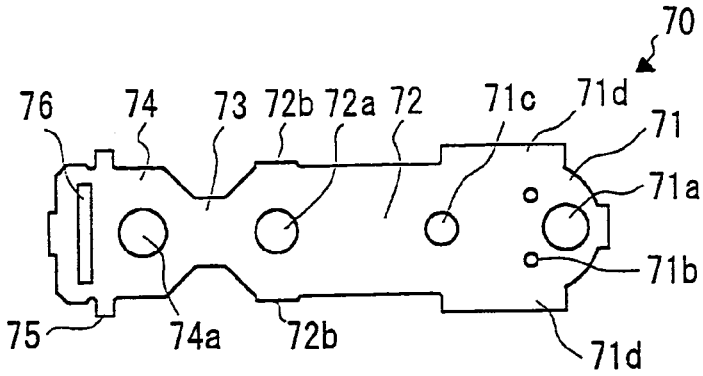
FIG. 9(*a*) is a top plan view of the movable plate prior to bending, FIGS. 9(*b*) and 9(*c*) are a top plan view and cross sectional front view of same after bending and with movable contact 77 mounted thereon, and FIGS. 9(*d*) and 9(*e*) are a top plan view and a cross sectional view similar to FIGS. 9(*b*) and (*c*) but after forming.
Figure 9B:
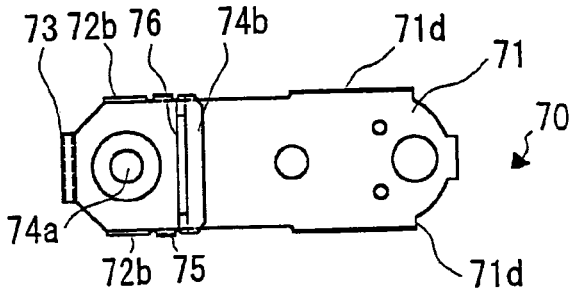
Figure 9C:
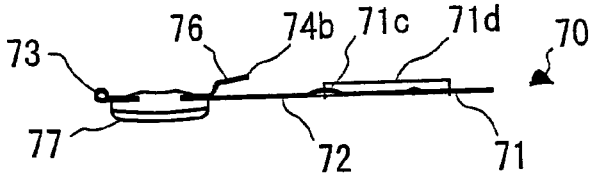
Figure 9D:
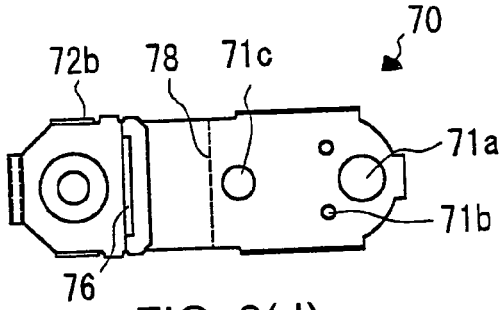
Figure 9E:
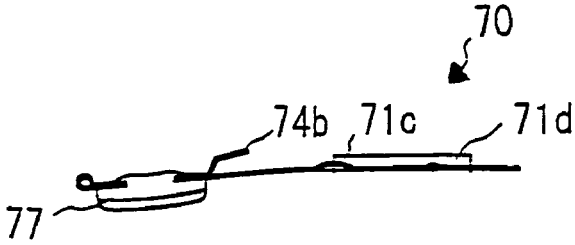

As shown in FIGS. 8(*a*), 8(*b*) and 8(*c*), arm assembly 60 includes a movable plate 70 and a bimetal disc 80. Movable plate 70 (see FIG. 9) has a base part 71, a flexible part 72 that extends from base 71, a narrow part 73 connected to flexible part 72 and a fold-back part 74 which is connected to narrow part 73. These are formed by punching a single metal sheet.

An opening 71*a* and a pair of circular protrusions 71*b* adjacent to opening 71*a* are formed on base 71. By adjusting the diameter of opening 71*a*, the cross sectional area of that part is adjusted along with the amount of heat produced from the base part of movable plate 70. Movable plate 70 functions as part of a current path and, at the same time, functions as a heat source for bimetal disc 80. A circular protrusion 71*c* is formed in movable plate 70 in the vicinity of the interconnection of base part 71 and flexible part 72. In addition, a longitudinally extending flange 71*d* is formed on both sides of base part 71. Flanges 71*d* form a part which is wider than flexible part 72 and this wider part extends to a position aligned with the center of the protrusion 71*c* or to the tip side beyond the center (contact side).

Flexible part 72 has a width which is approximately constant and is capable of bending. A pair of flanges 72*b* having an expanded width and an opening 72*a* at the center are formed at a location intermediate to the interconnection of flexible part 72 and narrow part 73. Part 73 includes an inclined width portion from flexible part 72 and is similarly connected to the fold back part 74. An opening 74*a* is formed at the fold back part 74 having the same shape as opening 72*a*. A tab 75 is formed on both sides of fold back part 74 and an oblong, transversely extending, slit-shaped window 76 is also formed in fold back part 74. Fold back part 74 is bent from the state shown in FIG. 9(*a*) to the state shown in FIG. 9(*b*). By bending the narrow part 73 of movable part 70, the fold back part 74 is arranged on the flexible part 72 with opening 74*a* of fold back part 74 aligned with opening 72*a* of flexible part 72. The free end of fold back part 74 is further bent away from flexible part 72 and faces upward, thereby forming an upstanding part 74*b*. As a result of this, the slit-shaped window 76 is upright relative to the surface of flexible part 72, thereby offering an opening providing access in a horizontal direction. Flanges 71*d* on both sides of base part 71 are bent generally perpendicularly relative to the face surface of main body 71, tabs 75 on both sides of the fold back part 74 are bent generally perpendicularly toward flexible part 72 and wide parts 72*b* of flexible part 72 are bent generally perpendicularly toward fold back part 74.

Subsequent to bending, a disc-shaped movable contact 77 is fixed as by welding or staking in the aligned openings 74*a*, 72*a* of fold back part 74 and elastic part 72, respectively, as shown in FIG. 9(*c*). Suitable material such as a clad material of silver nickel, silver cadmium oxide or silver tin oxide and copper, for instance, can be used for movable contact 77. Next, the tip part of movable plate 70, including movable contact 77, is bent along dashed line 78 of FIG. 9(*d*) to incline downwardly as seen in the figure. This is for the purpose of providing a load between movable contact 77 and stationary contact 40 when the arm assembly is installed in housing 10.

Figure 10:
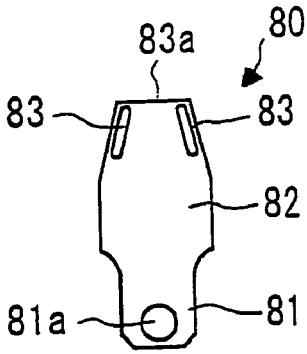
FIG. 10 is a top plan view of the bimetal disc.

Bimetal disc 80 is shown in FIG. 10 and has a base part 81 and a tongue-shaped snap acting part 82 that extends from base part 81. An opening 81*a* is formed on base part 81. A pair of oblong protrusions (ribs) 83 are formed along the longitudinal direction on opposite sides of the tip of snap acting part 82 in order to minimize creep motion prior to snap action of bimetal disc 80. Bimetal disc 80 is formed into a snap acting configuration using known techniques prior to installation so that it will snap between one dished configuration to an opposite dished configuration at selected actuation and reset temperatures.

Figure 11A:
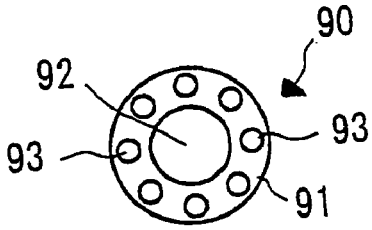
FIG. 11(*a*) is a top plan view of the weld slug and FIG. 11(*b*) is a cross sectional view taken through the weld slug.
Figure 11B:
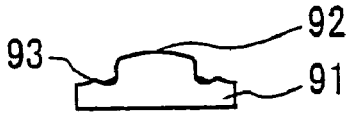
Figure 12A:
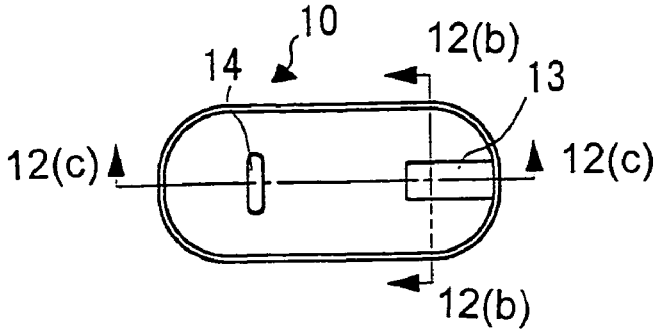
FIG. 12(*a*) is a top plan view of the housing, FIG. 12(*b*) is a cross section taken along line 12(*b*)—12(*b*) of FIG. 12(*a*), FIG. 12(*c*) is a cross section taken along line 12(*c*)—12(*c*) of FIG. 12(*a*)
FIG. 12*d* is a bottom plan view.
Figure 12B:
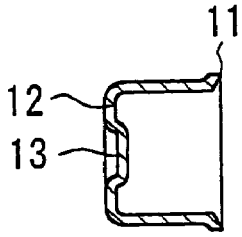
Figure 12C:
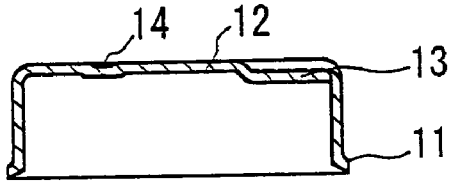
Figure 12D:
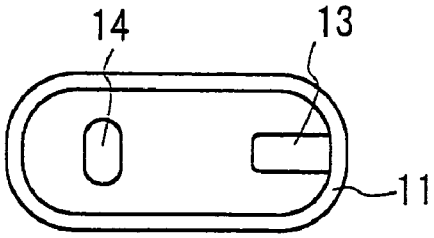

FIG. 11 shows the configuration of stationary metal weld slug 90 which is made of suitable material such as iron and includes a main body 91 in the shape of a disc and a circular protrusion 92 that protrudes from the center of the main body. A plurality of protrusions 93 for welding purposes are arranged at equal intervals along the circumference of body 91 and extend in the same direction as protrusion 92. The protruding part 92 of weld slug 90 is inserted into opening 71*a* of base 71 of movable plate 70 and the slug is welded to movable plate 70 via protrusions 93. Next, bimetal disc 80 is positioned on movable plate 70 with tip 83*a* of snap acting part 82 of bimetal disc 80 being inserted from the horizontal direction into window 76 of upstanding part 74*b* of movable plate 70 and protruding part 92 of slug 90 that extends through movable plate 70 being inserted into opening 81*a* of base part 81 of the bimetal disc. In addition, protrusions 71*b* on base 71 of movable plate 70 are welded to the base part 81 of bimetal disc 80 so that bimetal disc 80 is supported on the movable plate 70 in a cantilever fashion.

Thus assembled, arm assembly 60 is installed inside housing 10. As shown in FIG. 12, the housing is a metal container made of steel or the like, with one side being opened. The end part 11 that forms the open side of housing 10 is bent outwardly in order to facilitate welding to the surface of header 30. A longitudinally extending rib-like surface 13 for installation of arm assembly 60 and a transversely extending rib-like surface 14 where movable contact 77 is to be brought into contact when bimetal disc 80 has snapped moving contact 77 to the disengaged position, are formed on the bottom of housing 10.

Arm assembly 60 is mounted by welding the surface of protruding part 92 of slug 90 to rib 13. One end of the arm assembly 60 is supported like a cantilever on rib 13 by means of slug 90. Calibration is carried out for the adjustment of the position of the movable contact 77 at this time by pressing that portion that corresponds to rib 13 by means of a press or the like, from outside housing 10, thereby plastically deforming housing 10. The position of movable contact 77 is adjusted by varying the amount of pressing or the amount of deformation of rib 13.

Header pin assembly 20 is installed on housing 10 after calibration of the arm assembly is completed. End 11 of housing 10 is then welded to the surface of header 30 to complete the assembly of a protector 1 as shown in FIG. 1. At this time, movable contact 77, whose position has been accurately adjusted, is caused to engage the stationary contact with a certain contact force. The contact force can be adjusted by deforming housing 10 from outside as has been described earlier.

In view of the fact that the contact pressure also affects the temperature at which the snap action takes place, the optimal value is suitably selected in conformity with the protective characteristics of the electromotive compressor and the characteristics of protector 1.

Next, operation of protector 1 made according to this embodiment will be explained below:

Protector 1 is arranged inside a hermetic type electromotive compressor, pin 32 is connected to the common terminal of the fusite pin and pin 31 is connected to the winding of the motor. In applications in which the motor is in regular operation, the movable contact 77 of movable plate 70 engages the contact surface 42*a* of stationary contact 40 with a certain contact force. At this time, a current path is formed between pin 31 and pin 32 through stationary contact 40, movable plate 70, housing 10, header 30 and heater 50, thereby supplying electric power to the motor.

If the motor of the electromotive compressor is brought into constrained operation, a constrained current flows to protector 1 and, at the same time, heat is transmitted from the motor, etc. Heat which is in conformity with the constrained current is generated by heater 50 of protector 1 and, at the same time, heat is also generated from that part of movable plate 70 where the cross sectional area has been restricted by opening 71*a* of base 71 and the combined heat is transmitted to bimetal disc 80. If bimetal disc 80 exceeds the actuation temperature due to this heat, the bimetal disc initiates a snap action. Bimetal disc 80 has its base part 81 fixed in a cantilever fashion as described earlier, with its tip 83*a* being freely or loosely inserted inside window 76. In connection with the snap action, the snap acting part 82 of the bimetal disc contacts protrusion 71*c* formed on movable plate 70 as it snaps and levers the tip part 83*a* upwardly with the protrusion 71*c* as the fulcrum. Because of this, the movable plate 70 is bent and movable contact 77 moves away from stationary contact 40 and the opposite side of movable contact 77 engages the protruding rib 14 of housing 10.

In this condition, base 71 itself is essentially prevented from bending due to flanges 71*d* which extend to a position corresponding to the center of the protrusion 71*c* on both sides of base 71 of movable plate 70, with a result that the movable plate 70 bends beyond or out bound of protrusion 71*c*. When tip 83*a* of bimetal disc 80 engages the upper surface of window 76, the fold back part 74 and the elastic part 72 are lifted up integrally along with movable contact 77. In this manner, the movable plate 70 bends in conformity with movement of bimetal disc 80. As movable plate 70 moves movable contact 77 away from stationary contact 40 using protrusion 71*c* as a fulcrum, it becomes possible to accurately design the distance between both contacts when the movable contact 77 and the stationary contact 40 are opened in order to avoid the possibility of chattering action between the contacts. In addition, it becomes possible to limit the space required for the arm assembly by accurately controlling the position of movable contact 77 or movable plate 70, with a consequence that a reduction in the size of the protector 1 can be achieved.

When the ambient temperature of the protector 1 decreases below a certain reset temperature, bimetal disc 80 resets to the original state enabling energization of the electromotive compressor once again.

In accordance with the present embodiment, elastic deformation of base 71 is prevented and movable plate 70 is elastically deformed whenever disc 80 is in the actuated condition by using protrusion 71*c* as a fulcrum, so that movable contact 77 is prevented from engaging stationary contact 40 as a result of creep action of bimetal disc 80 until the disc resets. Moreover, bending of movable plate 70 caused by creep action of bimetal disc 80 is prevented by oblong protrusions 83 formed at the tip of the disc which is loosely inserted inside window 76 of the movable plate.

According to a feature of the invention, bimetallic disc 80, is not in the current path, thereby resulting in an absence of heat generation and actuation of bimetal disc 80 is primarily controlled by heat from the heater, thereby making it possible to increase the overload current that can be allowed to flow to the protector as compared with a conventional protector. As one terminal of the arm assembly 60 is electrically and thermally connected with housing 10, its heat generation due to electric current that flows through movable plate 70 can be effectively discharged through the housing. Further, heat generation from the stationary contact is controlled by increasing the thermal capacity of stationary contact 40. Heat generation by heater 50 is controlled and directed toward bimetal disc 80 due to the arrangement of the heater in a limited space and by separating the heater from the other component parts by means of spaces S2, S3 and S4. In this manner, the temperature range in which the bimetal disc actuates is much more restricted as compared with the conventional protector. In other words, the temperature at which the bimetal disc actuates can be controlled with a high degree of precision. As a consequence of this, the difference between the constrained current at the time of a constrained operation and the overload current at the time of an overload operation can be substantially reduced, thereby improving the operational efficiency of the electromotive compressor and the like.

Next, alternate embodiments of the invention will be explained. FIGS. 13 through 17 show other constructions of the arm assembly.

Figure 13:
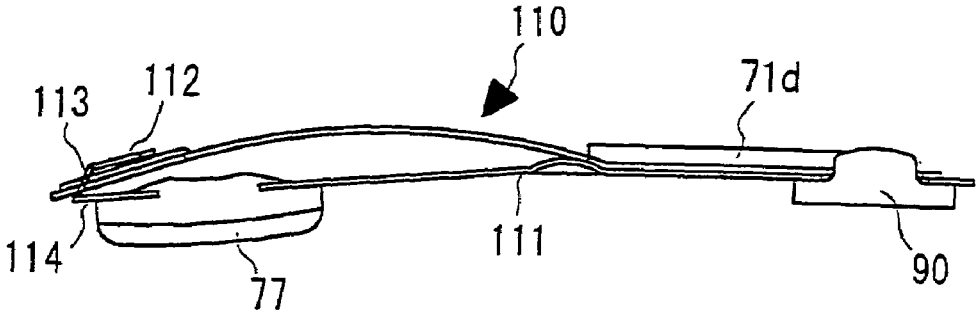
FIG. 13 is a cross section showing a variation of the arm assembly.

In the arm assembly shown in FIG. 13, an upstanding part 112 is formed at the tip of movable plate 111. A window 113 for the insertion and holding of the tip of bimetal disc 80 is formed in upstanding part 112 as in the case of the first embodiment of the invention. As the upstanding part 112 is positioned at end 114 of the arm assembly shown in this embodiment, end 114 follows it on snap action of bimetal disc 80. Because of this, it becomes possible to omit the fold back part 74 of movable plate 70 and wide part 72*b* of flexible part 72 as in the first embodiment.

Figure 14:
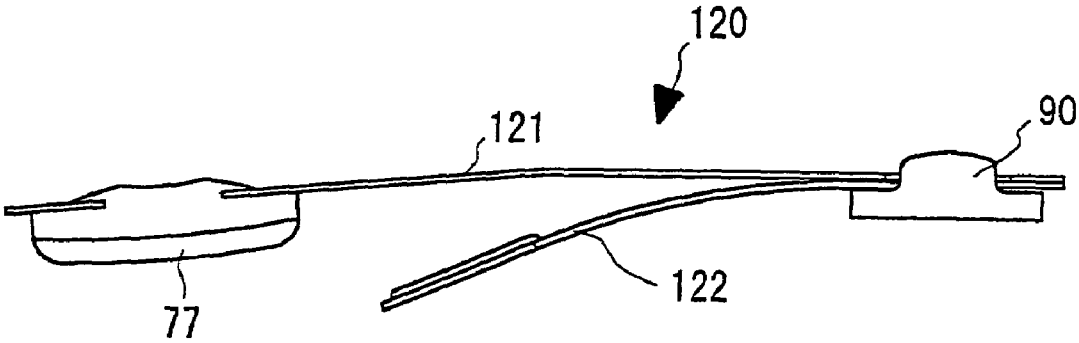
FIG. 14 is a cross section showing another variation of the arm assembly.

The arm assembly shown in FIG. 14 is for the purpose of arranging bimetal disc 122 below the movable plate 121 and mounting both of them in cantilever fashion by means of slug 90. In this case, there is no need to form the upstanding part, the window, protrusion 71*c* and flanges 71*d* for engagement with the bimetal disc on movable plate 121. In the case of the arm assembly in this embodiment, it is also possible to prevent any problem between the contacts due to creep action, while making its construction simple.

Figure 15:
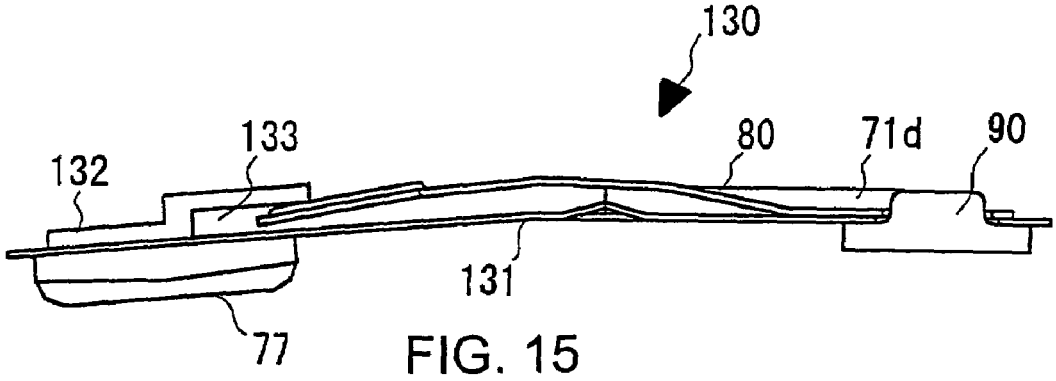
FIG. 15 is a cross section showing another variation of the arm assembly.

The arm assembly shown in FIG. 15 is an embodiment where the upstanding part that engages the bimetal disc has been formed using a separate part. Movable plate 131 includes movable contact 77 at the tip thereof. Upstanding part 132, having a stepped portion separated from the movable plate 70, is fixed to the movable plate 70 by welding or the like. A window 133 is formed between the separated stepped portion of part 132 and the movable plate 131 and the tip 83*a* of the bimetal disc 80 is inserted into window 133. As the upstanding part 132 is not formed by bending but by welding, etc., in this embodiment, the upstanding part 132 is displaced integrally with the movable plate 131 and movable contact 77.

Figure 16:
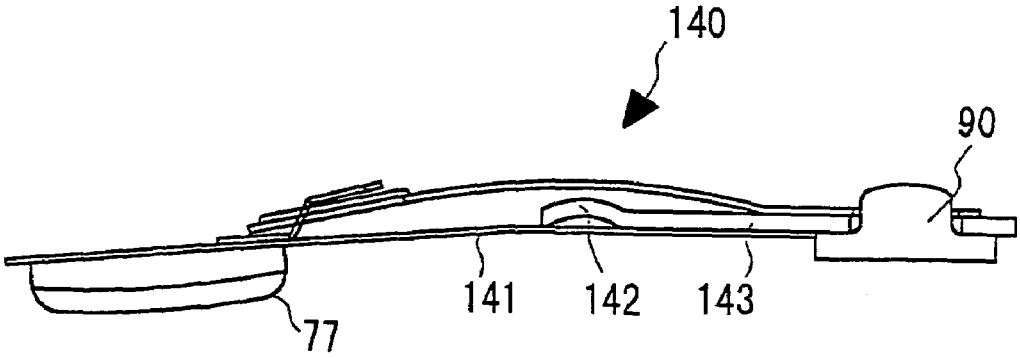
FIG. 16 is a cross section showing yet another variation of the arm assembly.

According to arm assembly 140 shown in FIG. 16, the fulcrum for bimetal disc 80 is provided by a separate part. A metal plate 143 that includes a protrusion 142 is inserted between movable plate 141 and bimetal disc 80. Weld slug 90 fixes movable plate 141, metal plate 143 and the base part of bimetal disc 80 and supports them in a cantilever fashion. It is also possible to prepare a plurality of metal plates 143 with different positions of the protrusion 142 and suitably select the metal plate 143 in conformity with the shape of the contacts, the size of the protector or the contact pressure between the contacts.

Figure 17:
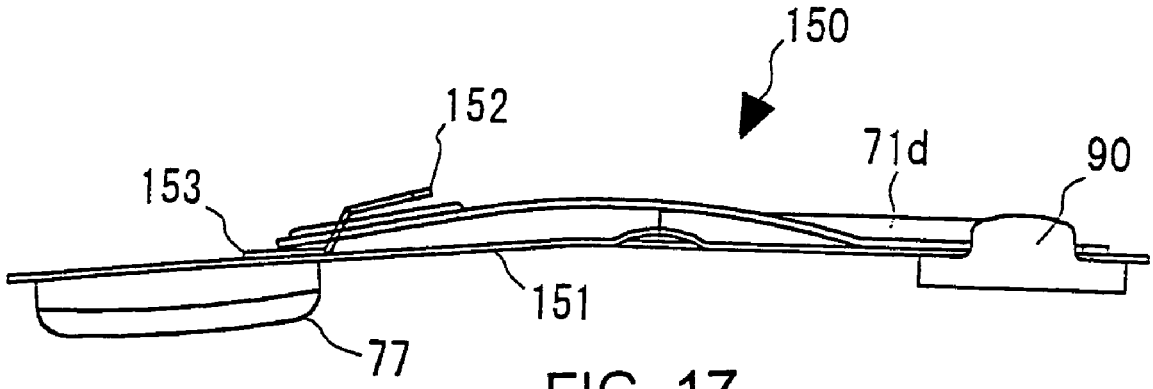
FIG. 17 is a cross section showing still another variation of the arm assembly.

In the arm assembly shown in FIG. 17 as well as FIG. 16, an upstanding part 152 is formed by a fold back portion of movable plate 151 and 141, respectively and, at the same time, a movable contact 77 is fixed to the tip of the movable plate as by welding without forming an opening comparable to opening 72*a*. In other respects, flanges 71*d* and the fulcrum of movable plate 151 of FIG. 17 is the same as in the first embodiment described above.

Figure 18A:
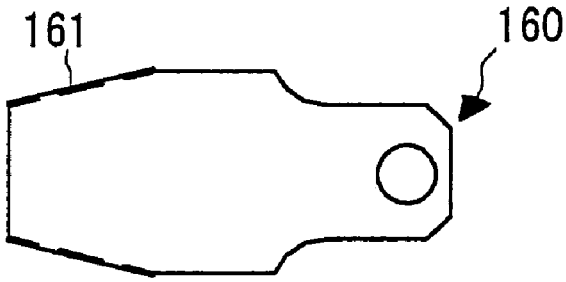
FIG. 18(*a*) is a top plan view and FIG. 18(*b*) is a cross section of a variation of the bimetal disc.
Figure 18B:
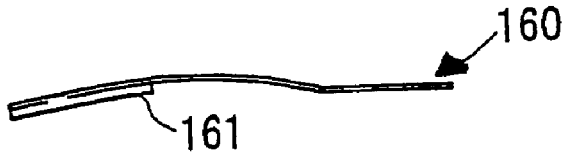

FIGS. 18(*a*), 18(*b*) show a variation of the bimetal disc. Flanges 161 are formed on opposite sides of bimetal disc 160 at the tip and bent generally perpendicular to the face surface of the disc instead of employing ribs 83 (refer to FIG. 10). As in the case of ribs 83, the flanges prevent creep movement of bimetal disc 160.

Figure 19:
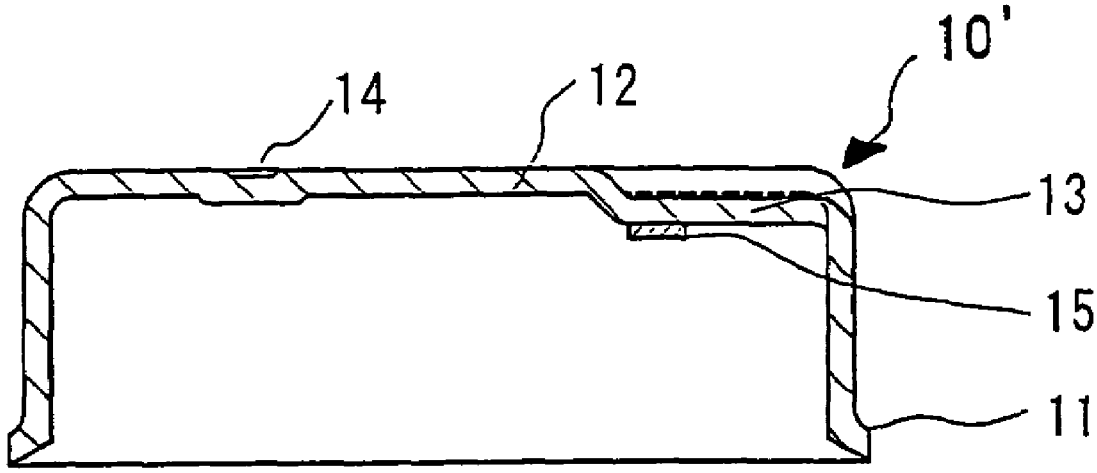
FIG. 19 is a cross sectional view showing a variation of the housing.

FIG. 19 shows a variation of the housing. Housing 10' in this embodiment has a block element 15 placed at a position at the inner extremity of rib 13. The block element 15 includes a flat surface and, when arm assembly 60 has been fixed to rib 13, the flat surface engages base part 81 of bimetal disc 80. Block element 15 is capable of preventing the bending of the base part of movable plate 70 and, as it absorbs heat from bimetal disc 80 during an overload operation of the electromotive compressor, discharge of heat to housing 10 is enhanced preventing premature actuation of the disc during an overload operation.

Figure 20:
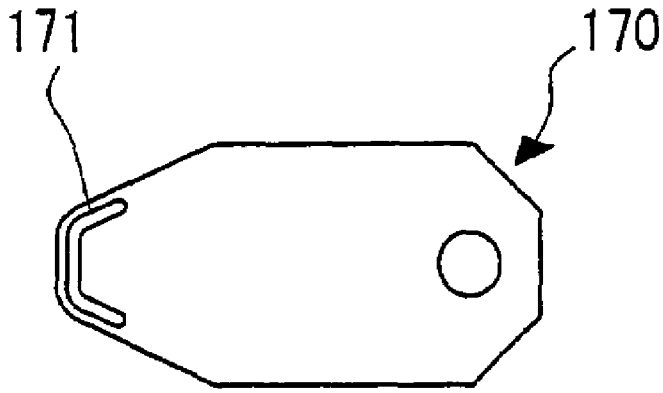
FIG. 20 is a top plan view of a variation of the bimetal disc.
Figure 21:
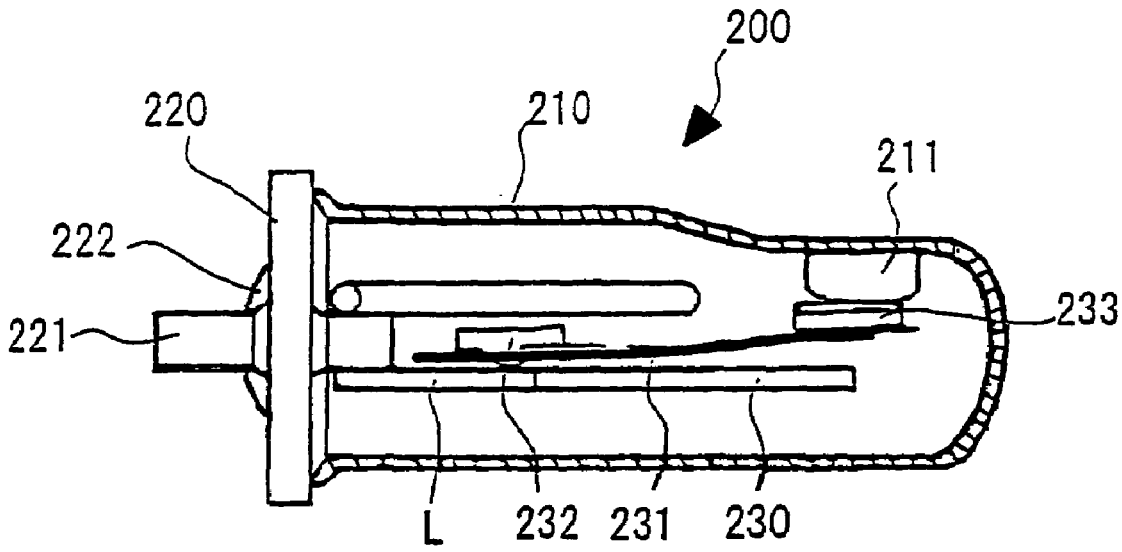
FIG. 21 PRIOR ART
FIG. 21 is a cross sectional view showing a conventional protector.

FIG. 20 shows another variation of the bimetal disc. In this embodiment, a generally U-shaped protruding rib 171 is formed at the tip of bimetal disc 170. By forming a rib 171 that extends in two dimensional directions in this manner, creeping of the bimetal disc in the longitudinal direction can be prevented and, at the same time, creep in the width direction can be prevented.

In the above embodiments, an electromotive compressor has been used as an example of equipment to be protected. However, it is possible to use other motors or compressors as the equipment to be protected. In the above embodiments, moreover, the protector is used inside the hermetic type electromotive compressor. However, it is not necessarily installed inside. In addition, the shapes and the materials to be used for the component parts can be suitably changed within the essence of this invention. For example, the contact surface 42*a* of stationary contact 40 is not necessarily limited to a flat surface. Instead, it can be formed as a semi-cylindrical shape. The semi-cylindrical shape provides a curved surface so that the contact area with the movable contact 77 can be reduced, thereby increasing the contact force per unit area.

According to the protector of this invention explained above, the thermally responsive member (preferably a bimetal disc) is not in the current path so that there is no restricting electric current that flows to the protector by the thermally responsive member. Moreover, generation of heat by the component parts in the protector is controlled and their heat dissipation is carried out efficiently. As a result of this, it becomes possible to make the electric current at the time of rated operation of equipment being protected larger than in the case of the conventional protector, thereby improving the operating efficiency of equipment to be protected.

Although the invention has been described with regard to certain specific embodiments thereof, variations and modifications will become apparent to those skilled in the art. It is therefore, the intention that the appended claims be interpreted as broadly as possible in view of the prior art to include all such variations and modifications.

What is claimed:

1. A protector comprising a header assembly having a metal plate mounting first and second terminals electrically isolated from one another and from the metal plate, a cup-shaped metal housing received on the header assembly forming a chamber, the housing having a top wall and a depending sidewall, a stationary electrical contact mounted on the first terminal, a heater element having first and second ends, the first end connected to the second terminal and the second end connected to the metal plate of the header assembly, an arm assembly having a movable plate and a snap acting thermally responsive member, each having first and second ends, the first ends of the movable plate and the snap acting member fixedly connected to the top wall of the housing, the snap acting member adapted to move between opposite dished configurations, an electrical movable contact, mounted on the second end of the movable plate and arranged to move into and out of engagement with the stationary electrical contact, the second end of the movable plate formed with an upstanding part extending upwardly from the movable plate and a transversely extending window being formed in the upstanding part, the second end of the snap acting thermally responsive member being loosely received in the window and arranged to move the second end of the movable plate when the snap acting member snaps from one dished configuration with the contacts in engagement to an opposite dished configuration with the contacts out of engagement with one another.

2. A protector according to claim 1 in which the second end of the movable plate is bent back over itself to form a double layer and the movable contact is fixed to a portion of the double layer, one layer of the double layer having a free end portion and the upstanding part is formed by bending the free end portion of the one layer away from the other layer.

3. A protector according to claim 1 in which the first and second terminals have side portions extending above the metal plate of the header assembly in the chamber and the stationary contact and the heater are attached to the side portion of the respective first and second terminals spaced from the metal plate of the header assembly.

4. A protector according to claim 1 in which the movable plate is formed with a protrusion extending upwardly toward the snap acting thermostatic member intermediate to the first and second ends to form a fulcrum for the snap acting thermostatic member and the movable plate is formed with stiffening surfaces extending from a location adjacent to the first end of the movable plate to a location in alignment with the upwardly extending protrusion.

5. A protector according to claim 1 in which the first end of the movable plate and the snap acting thermally responsive member are formed with a hole therethrough and a stationary weld member having a centrally disposed protrusion circumscribed by a marginal portion is placed so that the protrusion is received through the holes and is welded to the top wall of the housing and the movable plate and the snap acting thermally responsive member are welded to the marginal portion of the stationary weld member.

6. A protector comprising a metal header that secures a first terminal and a second terminal electrically isolated from one another and from the metal header, a metal housing secured to the header forming a chamber, a stationary contact electrically connected to the first terminal, a heater electrically connected to the second terminal and to the header and an arm assembly arranged in the chamber, the arm assembly including an electrically conductive movable plate mounting a movable contact engageable with the stationary contact, a snap acting thermally responsive member movable between oppositely dished configurations at selected temperatures arranged to lie along the movable plate, and an electrically conductive stationary member that secures the movable plate and the thermally responsive member to the housing, said movable plate being the primary current carrying member between said stationary member and said movable contact.

7. A protector according to claim 6 in which the movable plate and the thermally responsive member each have first and second ends, the first end being fixed in a cantilever fashion by means of the stationary member, a window being formed at the second end of the movable plate, the second end of the thermally responsive member being inserted into the window so that the movable plate is biased open by the thermally responsive member when the thermally responsive member snaps from one dished configuration to the opposite dished configuration.

8. A protector according to claim 7 where the second end of the thermally responsive member is loosely received in the window.

9. A protector according to claim 6 further comprising a protrusion formed on the movable plate, the protrusion functioning as a fulcrum when the thermally responsive member snaps from one configuration with the movable contact in engagement with the stationary contact to the opposite dished configuration.

10. A protector according to claim 7 where an upstanding flange is formed on opposite sides of the movable plate.

11. A protector according to claim 6 where said first and second terminals protrude through the header into the chamber and the stationary contact has a first part having a surface which can engage the movable contact, a second part having a cross section smaller than the first part, and a third part that extends from the second part, with the third part being fixed to the first terminal.

12. A protector according to claim 6 in which the heater includes a first connective part, a second connective part including a main body and a fuse part whose cross section is smaller than the first connective part and the second connective part and main body, the first connective part being fixed to said second terminal, the second connective part being fixed to said header and a bend is formed in the main body between said first and second connective parts and in the fuse part.

13. A protector according to claim 6 in which an opening is formed at the first end of the movable plate and the thermally responsive member, the stationary member includes a protuberant part that passes through each of the openings and the protuberant part is welded to the inner wall of the housing.

14. A protector according to claim 6 in which the thermally responsive member includes a bimetal disc with a rib being formed at the second end of the bimetal disc.

15. A protector according to claim 14 in which the rib includes a generally U-shaped configuration that protrudes from the surface of the bimetal disc.

16. A protector according to claim 13 in which the first end the movable plate and the first end of the thermally responsive member are welded together, and the cross sectional area of the movable plate is reduced by the opening thereby resulting in current generation of heat which is transmitted to the thermally responsive member.

* * * * *